US006276869B1

(12) United States Patent
Yakushinji

(10) Patent No.: US 6,276,869 B1
(45) Date of Patent: Aug. 21, 2001

(54) WEED CONTROL PLATE

(76) Inventor: Kuniaki Yakushinji, 59-2 Matsugaoka, Ooita-shi, Ooita 870-1168 (JP)

( * ) Notice: Subject to any disclaimer, the term of this patent is extended or adjusted under 35 U.S.C. 154(b) by 0 days.

(21) Appl. No.: 09/093,176

(22) Filed: Jun. 8, 1998

(30) Foreign Application Priority Data

Jul. 4, 1997 (JP) ..... 9-195135

(51) Int. Cl.[7] ..... E04H 17/00
(52) U.S. Cl. ..... 404/9; 47/25; 40/606; 256/1
(58) Field of Search ..... 404/9, 10, 12, 404/13; 47/25; 256/1; 40/606

(56) References Cited

U.S. PATENT DOCUMENTS

| | | | | |
|---|---|---|---|---|
| 1,540,192 | | 6/1925 | Smith . | |
| 2,978,837 | * | 4/1961 | Daniels | 47/25 |
| 3,305,969 | * | 2/1967 | Mattson | 47/25 |
| 3,571,972 | * | 3/1971 | Carter, Jr. | 47/25 |
| 3,704,004 | | 11/1972 | Carter | 256/1 |
| 4,584,789 | * | 4/1986 | Jean et al. | 47/25 |
| 4,926,785 | | 5/1990 | Lamson | 116/209 |
| 5,367,822 | * | 11/1994 | Beckham | 47/25 |
| 5,502,921 | * | 4/1996 | Hyslop | 47/25 |
| 5,743,505 | * | 4/1998 | Sofy | 248/346.01 |
| 5,878,528 | * | 3/1999 | Pattyn | 47/25 |

FOREIGN PATENT DOCUMENTS

| | | | | |
|---|---|---|---|---|
| 74 23 533 | | 10/1974 | (DE) . | |
| 38 20 698 | | 12/1989 | (DE) . | |
| 92 13 251 | | 12/1992 | (DE) . | |
| 84 37 812 | | 9/1993 | (DE) . | |
| 2660833 | * | 10/1991 | (FR) | 47/25 R |
| 2 295 835 | | 6/1996 | (GB) . | |
| 7-10020 | | 2/1995 | (JP) . | |
| 8-68022 | | 3/1996 | (JP) . | |
| 3029187 | | 7/1996 | (JP) . | |
| 8902317 | * | 4/1990 | (NL) | 47/25 R |

* cited by examiner

*Primary Examiner*—H. Shackelford
*Assistant Examiner*—Kristine M. Markovich
(74) *Attorney, Agent, or Firm*—Armstrong, Westerman, Hattori, McLeland & Naughton, LLP

(57) ABSTRACT

A weed control plate (1) installed at the root of one of supports of various kinds so as to cover the ground around the root to prevent the propagation of weeds. The weed control plate (1) is a thin plate having a conical surface. The plate is provided in the center thereof with an opening (11) for passing the support. The plate has a single parting line (13) extending from the outer periphery to the inner periphery of the plate. Two edges of the plate which are divided by the parting line (13) are fastened so as to join together with bolts (30) and nuts (31), thereby firmly fastening the inner peripheral surface of the opening (11) to the outer periphery of the support. The conical surface (10) is curved convexly upward toward radially inward of the plate. The inner peripheral surface of the opening (11) has a curved surface (25) projecting inward over approximately the entire circumference.

1 Claim, 5 Drawing Sheets

WEED CONTROL PLATE

BACKGROUND OF THE INVENTION

The present invention relates to a weed control plate capable of effectively preventing the propagation of weeds germinating at the roots of supports of guardrails or the like.

Guardrails are installed in such places as the boundary between a roadway and a sidewalk, the boundary between a roadway and a road shoulder, the boundary between a road and a slope face, and a median strip in a road. Weeds are likely to grow thick around the guardrails. The reason for this is that the seeds of weeds enter gaps produced around the supports of the guardrails which are driven into the ground even if the sidewalk, the roadway, the slope face and the median strip are paved, not to mention the unpaved ground, and the weeds take root into the gaps.

When cutting the weeds having luxuriated around the roots of the guardrail supports by using an automatic mower, it is necessary to take care not to touch the supports. Therefore, the weed cutting operation is considerably troublesome because of the presence of the obstructive supports. If the rotating cutting blade of the automatic mower touches a support, the cutting blade may break and injure the operator. On the other hand, it takes heavy labor to cut the weeds around the roots of the supports by a manual operation using a sickle or the like.

Under the above-described circumstances, it has heretofore been proposed to install, as shown in FIGS. 9 and 10, a weed control plate 200 or 250 at the root of each support of a guardrail.

More specifically, the weed control plate 200 shown in FIG. 9 has a cylindrical portion 201 and a flange portion 203 provided at the bottom of the cylindrical portion 201. The weed control plate 250 shown in FIG. 10 has a conical shape close to a flat plate. It is deemed that the propagation of weeds around the root of a support 300 can be suppressed to a certain extent by the weed control plate 200 or 250.

However, the conventional weed control plates 200 and 250 suffer from some problems as stated below.

(1) The weed control plate 200 shown in FIG. 9 is vertically split into two separate members to install it on the support 300. The two members of the weed control plate 200 are installed to clamp the support 300 from the right and left sides, and the cut edges of the two members are joined together. In this state, the joint portions are secured by a predetermined securing device, thereby installing the weed control plate 200.

However, the operation of installing the weed control plate 200 on the support 300 by joining together the two members is troublesome because it is necessary to align the two members with each other. In addition, the weed control plate 200 needs to secure the two vertically split members at two joint portions. The presence of two securing portions makes it likely that the clamping force with which the two members clamp the support 300 will weaken with time owing, for example, to expansion and contraction due to solar heat and vibrations caused by the passage of vehicles. If the clamping force weakens, the weed control plate 200 undesirably comes off the ground to become unable to fulfill its purpose.

(2) The weed control plate 250 shown in FIG. 10 is cut from the outer periphery to the inner periphery thereof along a single cutting line, and the weed control plate 250 is installed onto the support 300 by opening the cut portion of the plate 250. Thereafter, two edge portions of the plate 250 which are divided by the cutting line are overlaid on one another, and the overlaid portions are nailed on the ground, thereby installing the weed control plate 250.

However, nailing cannot provide very high strength for securing the weed control plate 250 to the ground. Therefore, the weed control plate 250 is likely to separate from the support 300 and fly away in a storm, e.g. a typhoon.

Even in the case of the asphalt ground, not to mention the unpaved ground, the strength with which the weed control plate 250 is secured to the ground by nails may be weakened, for example, by solar heat, vibrations caused by the passage of vehicles, or people's stepping on the plate 250. Accordingly, it is difficult for the weed control plate 250 to continue clamping the support 300 firmly for a long period of time. If the clamping force weakens, the weed control plate 250 undesirably comes off the ground to become unable to fulfill its purpose.

In a case where the weed control plate 250 is formed from a molding resin, the resin plate 250 may be deformed by solar heat. If the weed control plate 250 is deformed, the outer peripheral portion 253 of the weed control plate 250 may be bent to turn upward, and weeds may enter through the bent portion 253.

Although it is conical, the weed control plate 250 has an unfavorably weak strength because the slope angle of the conical surface is exceedingly small. Therefore, the weed control plate 250 may be readily broken if a heavy object, e.g. a vehicle, gets on it.

(3) The conventional weed control plates 200 and 250 are arranged such that the bottom surface of each plate is exactly perpendicular to the direction in which the support 300 stands. Therefore, if the support 300 does not stand perpendicular to the ground, the bottom of the weed control plate 200 or 250 cannot come into close contact with the ground but slopes at an angle to it, resulting in a gap. In such a case, the propagation of weeds cannot effectively be prevented. In a case where the ground is uneven, the bottom of the weed control plate 200 or 250 cannot come into close contact with the ground, resulting in a gap. In such a case also, the propagation of weeds cannot effectively be prevented.

SUMMARY OF THE INVENTION

Accordingly, an object of the present invention is to provide a weed control plate which can be readily installed on a support with a strong support clamping force without the likelihood of the outer peripheral portion thereof turning up regardless of the slope or unevenness of the ground.

The present invention is applicable to a weed control plate installed at the root of one of supports of various kinds so as to cover the ground around the root to prevent the propagation of weeds. According to the present invention, the weed control plate is a thin plate having a conical surface. The plate is provided in the center thereof with an opening for passing the support. The plate has a single parting line extending from the outer periphery to the inner periphery of the plate. Two edges of the plate which are divided by the parting line are fastened so as to join together with clamping members, thereby firmly fastening the inner peripheral surface of the opening to the outer periphery of the support.

According to the present invention, arranged as stated above, the weed control plate can be installed on the support simply by firmly fastening together the two edges of the plate divided by the parting line, which is provided in a single portion of the plate, directly with clamping members. Therefore, the installation operation is easy, and the clamping force with which the weed control plate clamps the support is strong and will not weaken with passage of time.

Even if expansion and contraction of the weed control plate due to solar heat or vibrations caused by the passage of vehicles occur continuously, there is no likelihood of the weed control plate coming off the ground.

Further, the weed control plate is a thin conical plate, and there is a space under the weed control plate. Therefore, even if the ground is uneven, the outer peripheral edge of the plate can be readily brought into close contact with the ground.

It is preferable that the conical surface of the weed control plate should be curved convexly upward toward radially inward of the plate.

If the conical surface of the weed control plate is formed into such a curved surface, the conical surface has an arched shape as a whole. Therefore, even if a heavy object such as a bicycle gets on the conical surface, the conical surface is sufficiently strong to bear such a heavy object and unlikely to be crushed. Even if the weed control plate is deformed by solar heat or the like, there is no likelihood that the outer peripheral edge of the plate will turn upward.

It is preferable that the inner peripheral surface of the opening, which is fastened to the support, has a curved surface projecting inward over approximately the entire circumference of the inner peripheral surface.

In a case where the inner peripheral portion of the opening has such a curved surface, even if the support does not stand perpendicular to the ground at the root of the support, the weed control plate can readily tilt from a direction perpendicular to the support. Thus, the outer peripheral edge of the weed control plate can be readily brought into close contact with the ground.

It is preferable that the opening should be provided with a cylindrical fastening portion to fasten the plate to the support, and a cut portion should be provided in a part of the fastening portion.

In a case where the fastening portion is provided with such a cut portion, even if the support does not stand perpendicular to the ground at the root of the support, the weed control plate can readily tilt from a direction perpendicular to the support. Thus, the outer peripheral edge of the weed control plate can be readily brought into close contact with the ground.

DESCRIPTION OF THE PREFERRED EMBODIMENTS

Embodiments of the present invention will be described below in detail with reference to the accompanying drawings.

[First Embodiment]

Figure 1:
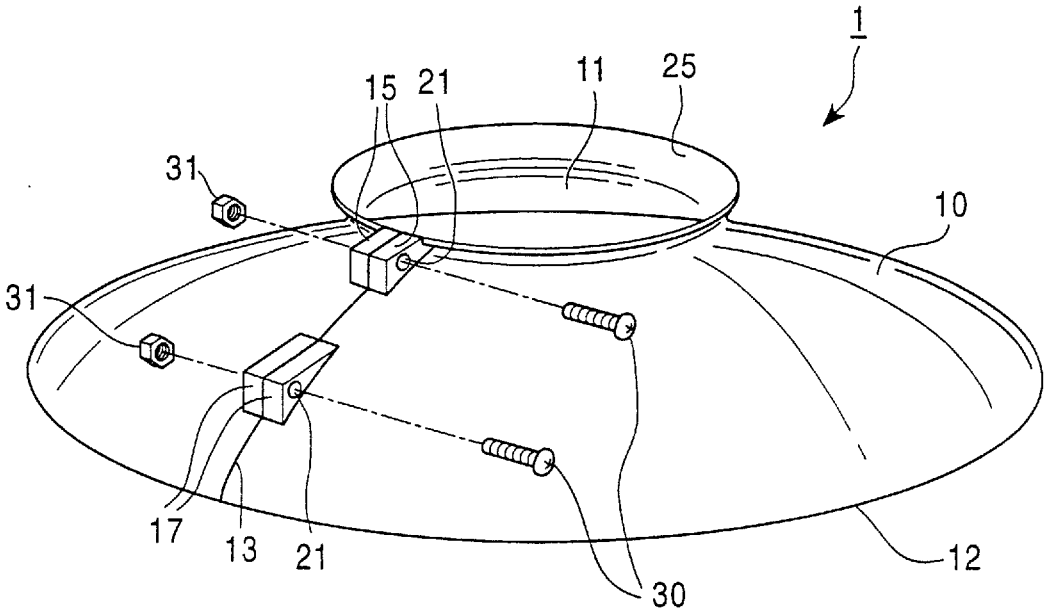
FIG. 1 is a perspective view showing a weed control plate according to a first embodiment of the present invention.
Figure 2:
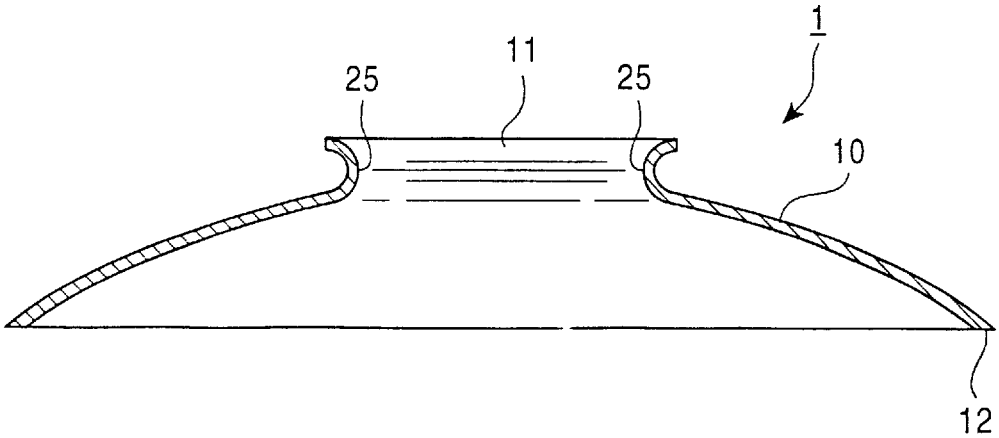
FIG. 2 is a sectional side view of the weed control plate shown in FIG. 1.

FIG. 1 is a perspective view of a weed control plate 1 according to a first embodiment of the present invention. FIG. 2 is a sectional side view of the weed control plate 1.

As shown in the figures, the weed control plate 1 is formed from a thin conical synthetic resin plate. The weed control plate 1 has a circular outer peripheral edge 12. A circular opening 11 for passing a support is provided in the center of the weed control plate 1. The weed control plate 1 is divided by a single straight parting line 13 extending from the outer periphery to the inner periphery of the plate 1. It should be noted that the weed control plate 1 is formed from a material of a color that does not readily transmit light.

On both sides of the parting line 13, two pairs of bolt fitting projections 15 and 17 are provided. The bolt fitting projections 15 and 17 are provided with through-holes 21, respectively.

As shown in FIG. 2, the weed control plate 1 has a conical surface 10 which is gently curved convexly upward toward radially inward of the weed control plate 1. As shown in FIG. 2, the peripheral edge of the opening 11 is curved arcuately toward the inner side of the opening 11, thereby forming a curved inner peripheral surface 25 projecting inwardly.

Figure 3:
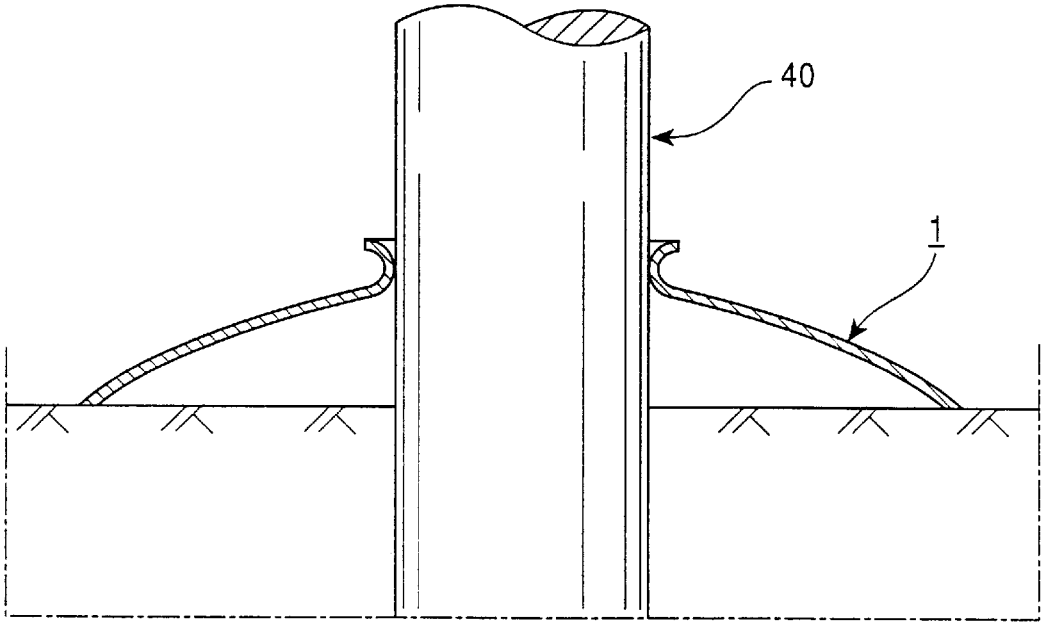
FIG. 3 is a sectional side view schematically showing the weed control plate as installed on a support.

To install the weed control plate 1 on a support of a guardrail, the cut portion at the parting line 13 of the weed control plate 1 is opened, and the plate 1 is fitted onto the guardrail support, which has previously been installed, such that the support is fitted in the opening 11. Then, the weed control plate 1 is lowered to the position of the root of the support, and the whole outer peripheral edge 12 is brought into close contact with the ground. Then, bolts 30 are inserted into the through-holes 21, which are provided in the bolt fitting projections 15 and 17 provided on both sides of the parting line 13, and nuts 31 are screwed onto the respective ends of the bolts 30 to firmly fasten together the two pairs of bolt fitting projections 15 and 17, thereby fixedly joining together the two opposing edges of the weed control plate 1. At the same time, the inner diameter of the opening 11 is reduced, and thus the support is firmly fastened. It should be noted that because supports for guardrails installed in general roads have a uniform diameter, the diameter of the opening 11 should be determined in conformity to the fixed diameter of guardrail supports (it should be noted that guardrail supports for expressways have a different diameter; therefore, weed control plates having a different diameter should be prepared separately for expressways). FIG. 3 is a sectional side view schematically showing the weed control plate 1 installed on a support 40 as described above.

According to the present invention, two opposing edges of the weed control plate 1 which are divided by the parting line 13, as shown in FIG. 1, are fixedly joined together by directly firmly fastening them together using clamping members, i.e. the bolts 30 and the nuts 31. Therefore, there is only one pair of edges to be joined together, and thus the installation operation is easy. Moreover, even if expansion and contraction of the weed control plate 1 due to solar heat or vibrations caused by the passage of vehicles occur continuously, the support clamping force is prevented from weakening with passage of time simply by fastening the bolts 30 and the nuts 31. Accordingly, there is no likelihood of the weed control plate 1 coming off the ground.

Moreover, because the conical. surface 10 of the weed control plate 1 is gently curved convexly upward toward radially inward of the weed control plate 1, it has an arched shape as a whole. Therefore, even if a heavy object such as a bicycle gets on the conical surface 10 or the rotating cutting blade of an automatic mower collides against the conical surface 10, the conical surface 10 is sufficiently strong to bear such a heavy object and collision and unlikely to be crushed or broken. Even if the weed control plate 1 is deformed by solar heat or the like, there is no likelihood that the outer peripheral edge 12 will turn upward.

Figure 4:
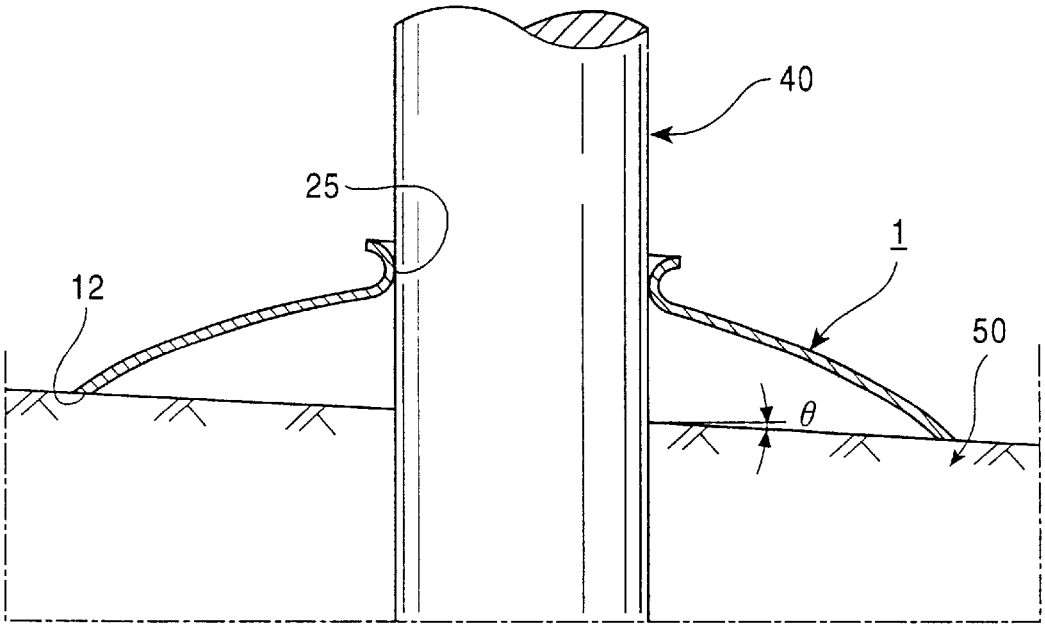
FIG. 4 is a sectional side view schematically showing the relationship between the weed control plate installed on the support and the ground.

Further, according to the present invention, the inner peripheral portion of the opening 11 has the curved surface 25 as in this embodiment. Therefore, as shown in FIG. 4, even if the support 40 does not stand perpendicular to the ground 50 at the root of the support 40 (inclination angle θ), the weed control plate 1 can readily tilt from a direction perpendicular to the support 40 (inclination angle θ). Thus, the outer peripheral edge 12 can be readily brought into close contact with the ground 50.

Figure 5:
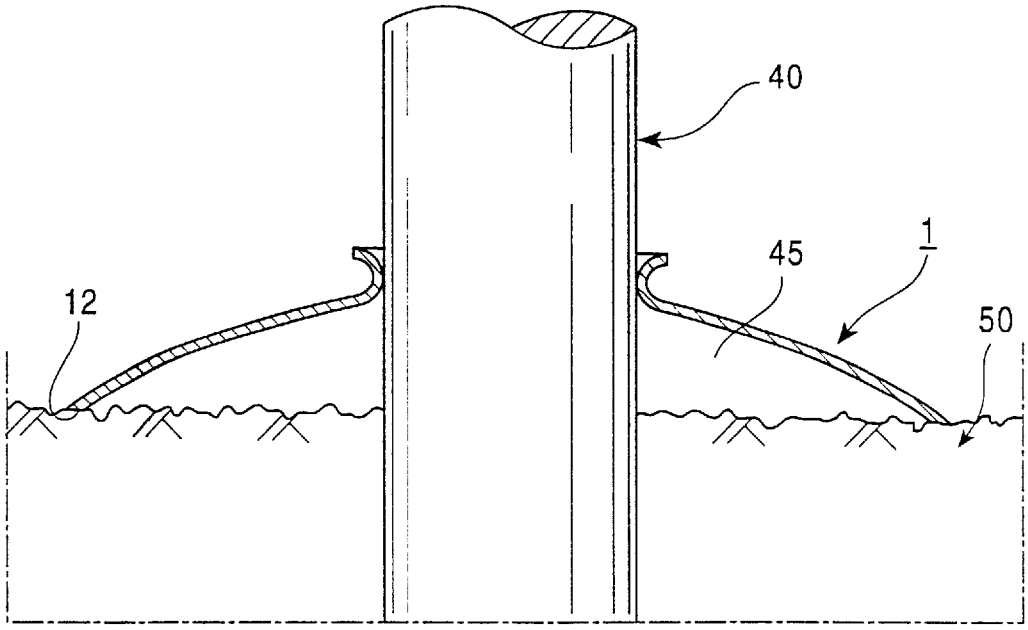
FIG. 5 is a sectional side view schematically showing the relationship between the weed control plate installed on the support and the ground.

Further, as shown in FIG. 5, there is a space 45 under the weed control plate 1. Therefore, even if the ground 50 is uneven, the outer peripheral edge 12 can be readily brought into close contact with the ground 50.

[Second Embodiment]

Figure 6:
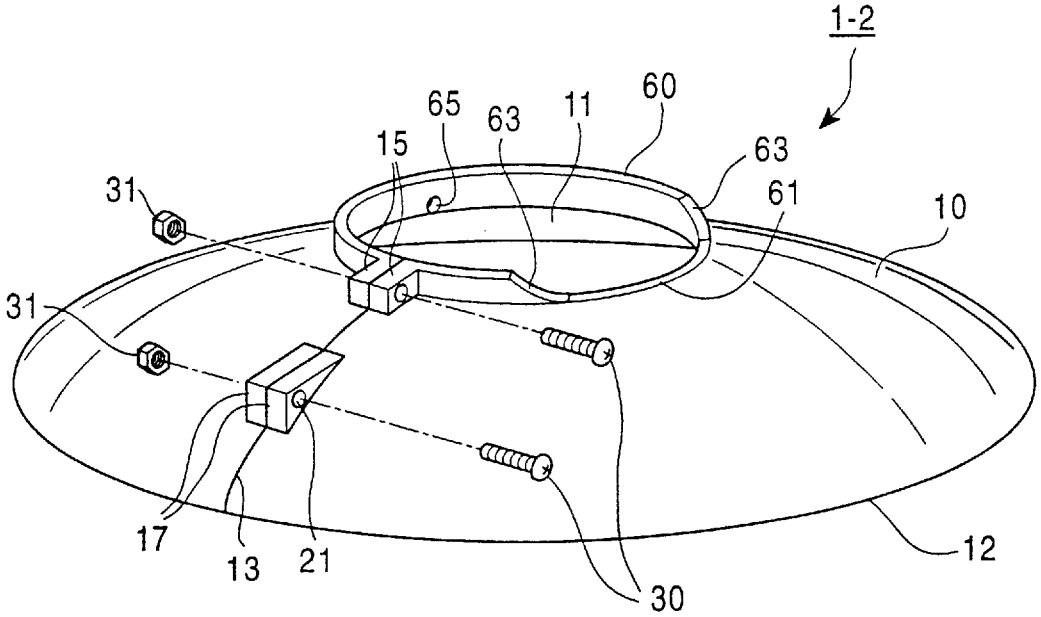
FIG. 6 is a perspective view showing a weed control plate according to a second embodiment of the present invention.

FIG. 6 is a perspective view showing a weed control plate 1-2 according to a second embodiment of the present invention. In this embodiment, the same elements or portions as those in the first embodiment are denoted by the same reference numerals, and a detailed description thereof is omitted.

This embodiment differs from the first embodiment only in the configuration of the opening 11. That is, in the first embodiment, the inner peripheral surface of the opening 11 is formed into the curved surface 25, thereby enabling the outer peripheral edge 12 of the weed control plate 1 to be readily brought into close contact with the ground even if the support does not stand perpendicular to the ground. In this embodiment, a cut portion 61 is. provided in a part of a cylindrical fastening portion 60 projecting from the peripheral edge of the opening 11. Each side edge 63 of the cut portion 61 is formed into an approximately circular-arc shape.

It should be noted that the fastening portion 60 is provided with a through-hole 65 for drainage at a position opposite to the cut portion 61.

The weed control plate 1-2 is installed on a support of a guardrail by using bolts 30 and nuts 31 as in the case of the first embodiment.

Figure 7:
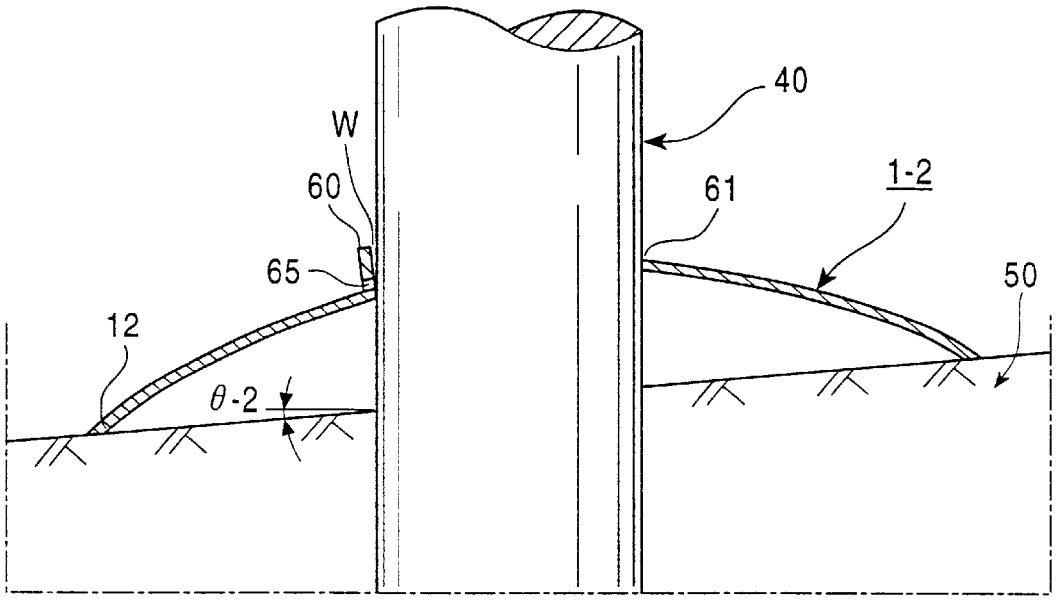
FIG. 7 is a sectional side view schematically showing the relationship between the weed control plate according to the second embodiment as installed on a support and the ground.

FIG. 7 shows the way in which the weed control plate 12 is installed in a case where the ground 50 slopes at an angle to the support 40.

If the fastening portion 60 of the weed control plate 1-2 does not have a cut portion 61, the weed control plate 1-2 can be fixed only in the direction of a plane perpendicular to the standing direction of the support 40 and cannot be installed on the ground 50 sloping at an angle to the support 40. In this embodiment, because the fastening portion 60 is provided with the cut portion 61, the support 40 enters the cut portion 61, as shown in FIG. 7, thereby allowing the weed control plate 1-2 to be readily slanted from the perpendicular direction (inclination angle θ-2), and thus enabling the outer peripheral edge 12 to be readily brought into close contact with the ground 50.

It should be noted that when the weed control plate 1-2 is slantingly installed on the support 40, a gap W is produced between the support 40 and the upper end of the fastening portion 60 at a position opposite to the cut portion 61. Therefore, rain water or the like is likely to collect in the gap W.

In this embodiment, however, water collecting in the gap W can be drained through the through-hole 65.

It should be noted that the opening for drainage is not necessarily limited to a through-hole but may be a cut made in the fastening portion 60 from the upper edge thereof.

Although the embodiments of the present invention have been described above in detail, the present invention is not necessarily limited to these embodiments but can be modified in a variety of ways, for example, as stated below:

(1) As devices for fixedly joining together the two edges of the weed control plate 1 or 1-2, which are divided by the parting line 13, various clamping members are usable in addition to bolts and nuts.

Figure 8:
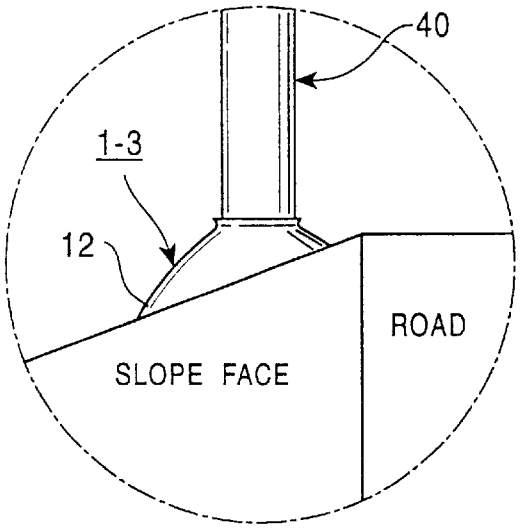
FIG. 8 is a side view schematically showing an example of use of a weed control plate having a different configuration.
Figure 9:
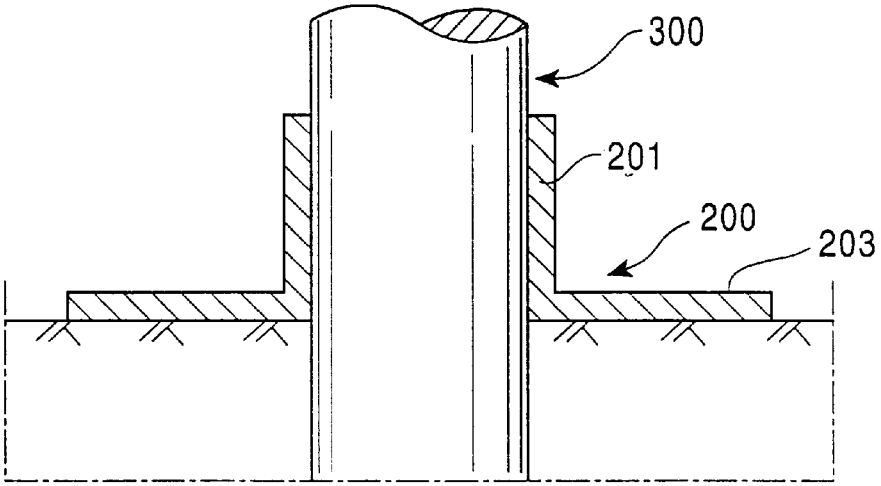
FIG. 9 PRIOR ART
FIG. 9 is an illustration of a conventional weed control plate.
Figure 10:
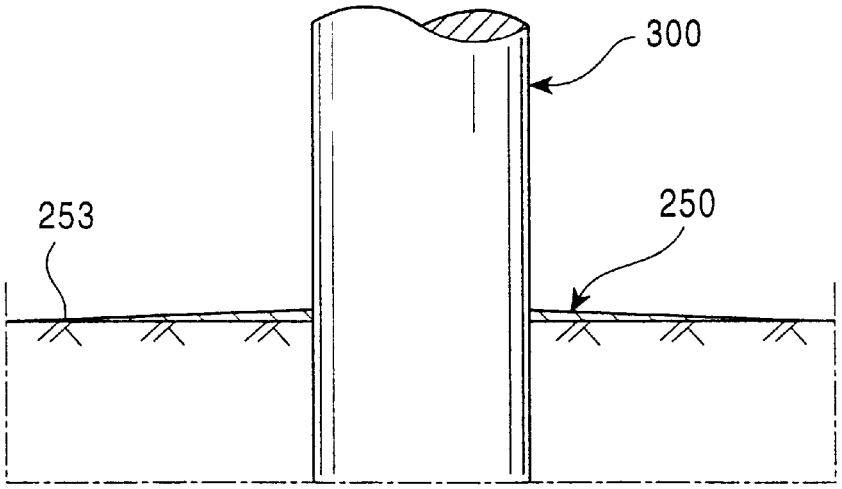
FIG. 10 PRIOR ART
FIG. 10 is an illustration of another conventional weed control plate.

(2) In a case where the angle of inclination of the guardrail support 40 with respect to the ground is excessively large as shown in FIG. 8, it may be impossible to cope with the situation by only the curved surface 25 (or the cut portion 61) provided at the opening 11. In such a case, the outer peripheral edge 12 may be cut obliquely.

(3) Although in the foregoing embodiments the weed control plate is installed on a support of a guardrail, the present invention is not necessarily limited to the described usage but may be applied to any supports as long as they are stood on the ground, e.g. supports for road signs.

Further, the present invention may be carried out in various other forms without departing from the spirit and essential features thereof. Therefore, the above-described embodiments are merely illustrative examples, and the present invention should not be construed as being limited to the described embodiments. The technical scope of the present invention is defined by the appended claims, and it is not bound to this specification. Furthermore, all changes and modifications within the technical scope of the claims come within the scope of the present invention.

What is claimed is:

1. A weed control plate, installed at a root of one of supports of various kinds so as to cover the ground around said root to prevent propagation of weeds, comprising:

a thin plate having a conical surface, said plate being provided in a center thereof with an opening for passing the support, said plate having a single parting line extending from an outer periphery to an inner periphery of said plate, wherein said conical surface is curved convexly upward toward radially inward of said plate, wherein two edges of said plate which are divided by said parting line are fastened so as to join together with a clamping member, thereby firmly fastening an inner peripheral surface of said opening to an outer periphery of said support, and wherein said plate is provided with a cylindrical fastening portion having therein a cut-out portion, each side edge of said cut-out portion being formed into an approximately circular-arc shape.

* * * * *